US011035579B2

(12) United States Patent
Hisayama et al.

(10) Patent No.: US 11,035,579 B2
(45) Date of Patent: Jun. 15, 2021

(54) REFRIGERATION CYCLE APPARATUS

(71) Applicant: DAIKIN INDUSTRIES, LTD., Osaka (JP)

(72) Inventors: Kazushi Hisayama, Osaka (JP); Tetsuya Okamoto, Osaka (JP); Yoshinobu Tsumura, Osaka (JP); Kebi Chen, Osaka (JP); Masanori Ukibune, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/043,222

(22) PCT Filed: Mar. 28, 2019

(86) PCT No.: PCT/JP2019/013622
§ 371 (c)(1),
(2) Date: Sep. 29, 2020

(87) PCT Pub. No.: WO2019/189584
PCT Pub. Date: Oct. 3, 2019

(65) Prior Publication Data

US 2021/0018189 A1 Jan. 21, 2021

(30) Foreign Application Priority Data

Mar. 30, 2018 (JP) ..... JP2018-070229

(51) Int. Cl.
*F24F 1/12* (2011.01)

(52) U.S. Cl.
CPC ..... *F24F 1/12* (2013.01)

(58) Field of Classification Search
CPC ..... F24F 1/12; F24F 1/20; F24F 1/24; F24F 1/40
USPC ..... 62/259.1
See application file for complete search history.

(56) References Cited

U.S. PATENT DOCUMENTS 5,306,121 A * 4/1994 Heflin ..... F04B 39/0044 248/638
6,336,794 B1 1/2002 Kim
2005/0081550 A1 4/2005 Lee et al.
2013/0112282 A1 5/2013 Uto et al.
(Continued)

FOREIGN PATENT DOCUMENTS

EP 2 848 877 A2 3/2015
JP S6179922 A * 4/1986
(Continued)

OTHER PUBLICATIONS

International Search Report issued in PCT/JP2019/013622 (PCT/ISA/210), dated Jun. 4, 2019.
(Continued)

*Primary Examiner* — Steve S Tanenbaum
(74) *Attorney, Agent, or Firm* — Birch, Stewart, Kolasch & Birch, LLP

(57) ABSTRACT

A refrigeration cycle apparatus includes a compressor, a refrigerant cooling pipe, a refrigerant-cycle constituent component, a connecting pipe and vibration transmission suppressing portion that is disposed on the connecting pipe that connects the refrigeration-cycle constituent component or the compressor and the refrigerant cooling pipe to each other.

14 Claims, 5 Drawing Sheets

(56) References Cited

U.S. PATENT DOCUMENTS

| | | | |
|---|---|---|---|
| 2015/0059389 | A1 | 3/2015 | Liu et al. |
| 2015/0300683 | A1 | 10/2015 | Boecker et al. |

FOREIGN PATENT DOCUMENTS

| | | | | |
|---|---|---|---|---|
| JP | H5-10843 | U | | 2/1993 |
| JP | 2002-89445 | A | | 3/2002 |
| JP | 2003-232543 | A | | 8/2003 |
| JP | 2005-241197 | A | | 9/2005 |
| JP | 2010-145054 | A | | 7/2010 |
| JP | 2010145054 | A | * | 7/2010 |
| JP | 2011-052842 | A | | 3/2011 |
| JP | 2012-107583 | A | | 8/2012 |
| JP | 2017-141988 | A | | 8/2017 |
| WO | WO 2012/029086 | A1 | | 8/2012 |
| WO | WO 2013/122451 | A1 | | 8/2012 |

OTHER PUBLICATIONS

International Preliminary Report on Patentability and English translation of the Written Opinion of the International Searching Authority dated Oct. 15, 2020 for Application No. PCT/JP2019/013622.
Extended European Search Report dated Mar. 12, 2021 in corresponding European Application No. 19777682.6.

* cited by examiner

REFRIGERATION CYCLE APPARATUS

TECHNICAL FIELD

The present disclosure relates to a refrigeration cycle apparatus.

BACKGROUND ART

In some usage environments, a refrigeration cycle apparatus is required to have low-noise performance. To achieve low-noise performance, it is required to suppress vibration from being transmitted to the entirety of the apparatus when a compressor constituting a refrigerant circuit vibrates. For such a purpose, Patent Literature 1 (Japanese Unexamined Patent Application Publication No. 2005-241197) discloses a double anti-vibration structure. That is, a support member is disposed in a housing via a second anti-vibration member, and a compressor is mounted on the support member via a first anti-vibration member. In Patent Literature 1, an air heat exchanger, a water heat exchanger, and the like, which are refrigeration-cycle constituent components, are also disposed, as appropriate, on the support member.

SUMMARY OF INVENTION

Technical Problem

Patent Literature 1 includes no description about an electric component. In general, an electric component that performs overall control of a refrigeration cycle apparatus is generally fixed to a housing. In particular, when a double anti-vibration structure is employed, the space in a housing is decreased, and thus, it is common to fix such an electric component in a housing upper portion where there is relatively more space.

Electric components include a large number of elements, and some of the elements generate a large amount of heat. There are thus some electric components for which it is desirable to perform cooling. For cooling of electric components, a technique of refrigerant cooling is also known (refer to, for example, Japanese Unexamined Patent Application Publication No. 2010-145054).

During cooling of an electric component by refrigerant cooling, when the electric component is fixed to a housing with a refrigeration-cycle constituent component to which a refrigerant pipe is connected being fixed to a support member, displacement is generated between the refrigerant-cycle constituent component and the electric component by the vibration of the support member. There is a problem that a stress is thereby generated on a pipe connecting the refrigeration-cycle constituent component and a member that cools the electric component.

Solution to Problem

A refrigeration cycle apparatus according to a first aspect includes a housing, a second elastic member, a base, a first elastic member, a compressor, an electric component, a heat transfer plate, a refrigerant cooling pipe, a refrigeration-cycle constituent component, and a connecting pipe. The housing includes a bottom member. The second elastic member is disposed on the bottom member. The base is disposed on the bottom member via the second elastic member. The first elastic member is disposed on the base. The compressor is configured to compress a refrigerant. The compressor is disposed on the base via the first elastic member. The electric component is configured to drive a motor for the compressor. The electric component is fixed to the housing. The heat transfer plate is fixed to the electric component. The refrigerant cooling pipe causes the refrigerant to circulate therein. The refrigeration-cycle constituent component is fixed to the base and causes the refrigerant to circulate. The connecting pipe causes the refrigerant to circulate. The connecting pipe connects the refrigeration-cycle constituent component or the compressor and the refrigerant cooling pipe to each other. The refrigerant cooling pipe is fixed to the heat transfer plate and is configured to cool the electric component via the heat transfer plate. The connecting pipe includes a vibration transmission suppressing portion. The vibration transmission suppressing portion suppresses vibration of the refrigeration-cycle constituent component or the compressor fixed to the base from being transmitted to the refrigerant cooling pipe.

In the refrigeration cycle apparatus according to the first aspect, due to the presence of the vibration transmission suppressing portion, vibration of the refrigerant cooling pipe is suppressed, and a stress applied to the pipe is suppressed.

A refrigeration cycle apparatus according to a second aspect is the refrigeration cycle apparatus according to the first aspect, in which the refrigeration-cycle constituent component is one that is included in a group consisting of an economizer heat exchanger, an expansion valve, a check valve, an air heat exchanger, a water heat exchanger, a four-way switching valve, an accumulator, and a receiver, or a combination thereof.

A refrigeration cycle apparatus according to a third aspect is the refrigeration cycle apparatus according to the first aspect or the second aspect, in which the vibration transmission suppressing portion is fixed to the housing.

A refrigeration cycle apparatus according to a fourth aspect is the refrigeration cycle apparatus according to the third aspect, in which the vibration transmission suppressing portion is fixed to the bottom member.

A refrigeration cycle apparatus according to a fifth aspect is the refrigeration cycle apparatus according to any one of the first aspect to the fourth aspect, the refrigeration cycle apparatus further including a third elastic member disposed between the vibration transmission suppressing portion and the housing.

In the refrigeration cycle apparatus according to the fifth aspect, it is possible to reduce vibration energy that is transmitted to the housing because the third elastic member attenuates vibration.

A refrigeration cycle apparatus according to a sixth aspect is the refrigeration cycle apparatus according to the fifth aspect, in which a spring constant of the third elastic member is more than or equal to a spring constant of the second elastic member.

In the refrigeration cycle apparatus according to the sixth aspect, it is possible to more reliably reduce the vibration that is transmitted to the housing.

A refrigeration cycle apparatus according to a seventh aspect is the refrigeration cycle apparatus according to the first aspect or the second aspect, in which the vibration transmission suppressing portion is a trap including a bent portion.

In the refrigeration cycle apparatus according to the seventh aspect, the trap absorbs displacement resulting from the vibration of the base and can suppress the vibration of the refrigerant cooling pipe.

A refrigeration cycle apparatus according to an eighth aspect is the refrigeration cycle apparatus according to the first aspect or the second aspect, in which the vibration transmission suppressing portion is a pipe having flexibility.

In the refrigeration cycle apparatus according to the eighth aspect, the pipe having flexibility absorbs displacement resulting from the vibration of the base and can suppress the vibration of the refrigerant cooling pipe.

DESCRIPTION OF EMBODIMENTS

First Embodiment

(1) Configuration of Refrigerant Circuit of Refrigeration Cycle Apparatus

Figure 1:
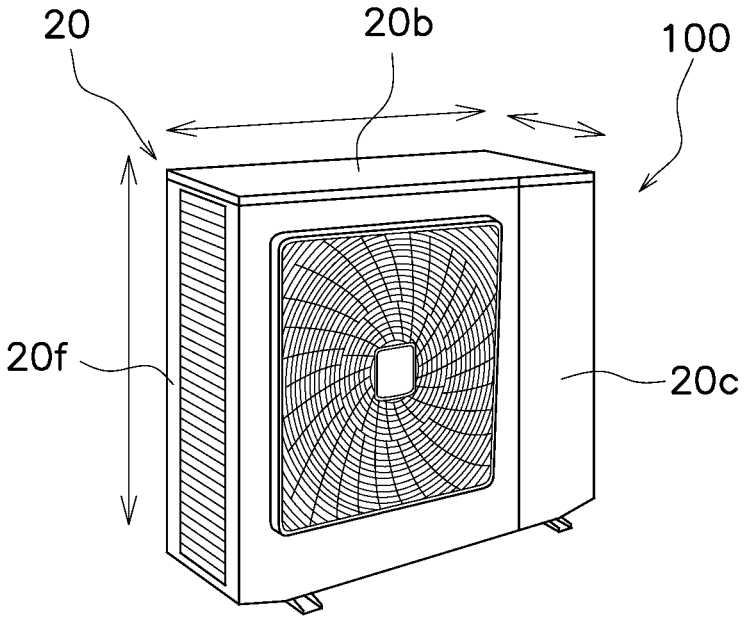
FIG. 1 is a perspective view of an appearance of a refrigeration cycle apparatus of a first embodiment.
Figure 2:
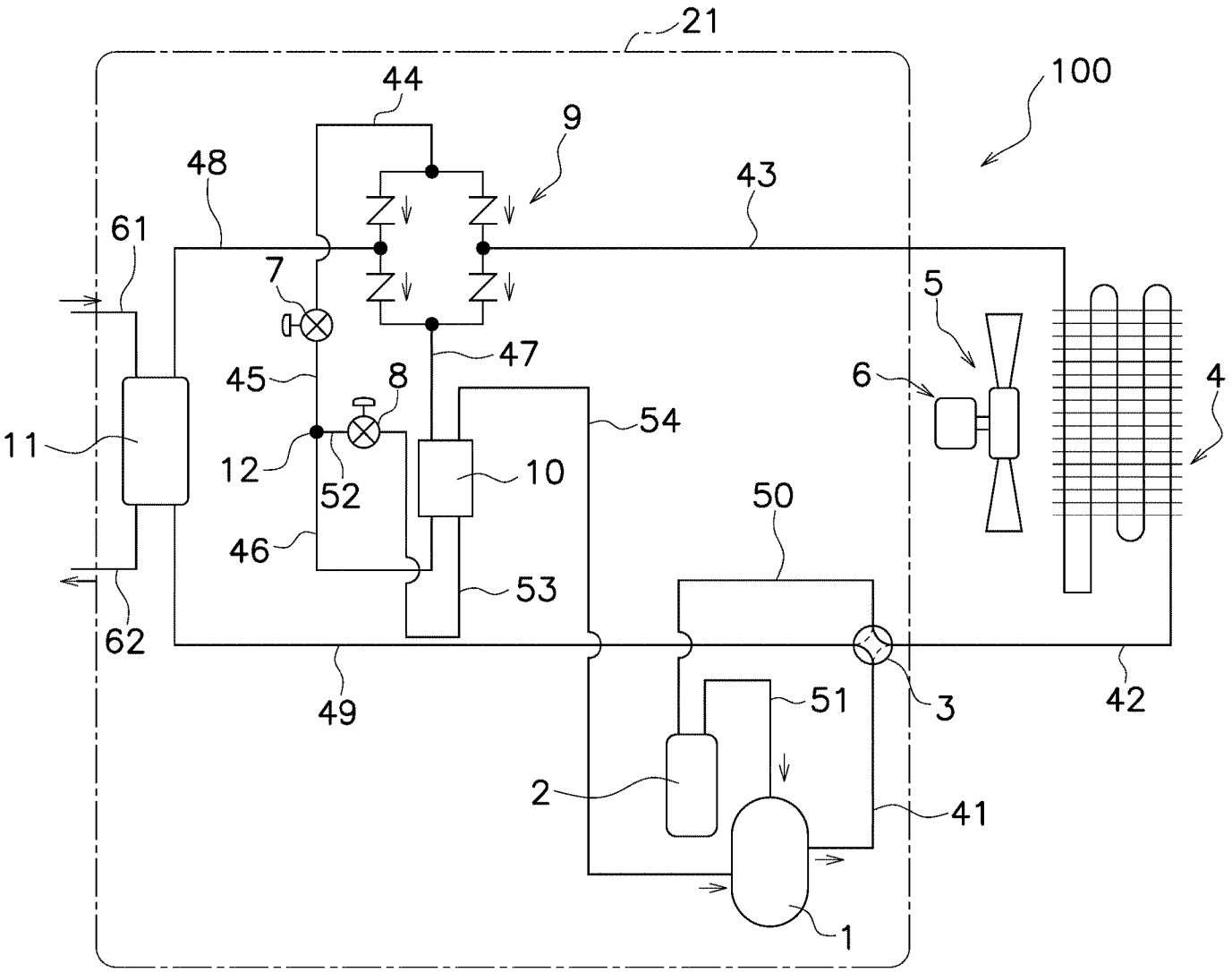
FIG. 2 is a diagram of a refrigerant circuit of the refrigeration cycle apparatus of the first embodiment.

A perspective view of an appearance of a refrigeration cycle apparatus 100 of a first embodiment and a refrigerant circuit are illustrated in FIG. 1 and FIG. 2, respectively. The refrigeration cycle apparatus of the present embodiment is an apparatus that uses a heat pump and that heats and/or cools water. By using heated or cooled water, the refrigeration cycle apparatus 100 can be utilized as a water heater or a water cooler. Alternatively, by using heated or cooled water as a medium, the refrigeration cycle apparatus 100 may constitute an air conditioning apparatus that performs heating and cooling.

As illustrated in FIG. 2, the refrigerant circuit of the refrigeration cycle apparatus 100 of the present embodiment includes a compressor 1, an accumulator 2, a four-way switching valve 3, an air heat exchanger 4, a check valve 9, a first expansion valve 7, a second expansion valve 8, an economizer heat exchanger 10, and a water heat exchanger 11. With each device and a junction 12 connected to each other by pipes 41 to 54, a refrigerant circulates in each device, and a vapor compression refrigeration cycle is performed. The pipes 41 to 54 are each constituted by a highly heat-conductive member of copper, aluminum, or the like. The refrigeration cycle apparatus further includes a fan 5 that sends air to the air heat exchanger 4, and a fan motor 6 that drives the fan.

When water is to be heated, the refrigeration cycle apparatus 100 operates as follows. The refrigerant is compressed by the compressor 1 and sent to the water heat exchanger 11, which acts as a condenser. The refrigerant is decompressed by, mainly, the first expansion valve 7, vaporized by the air heat exchanger 4, which acts as an evaporator, and sent to the compressor 1 again. Water enters the water heat exchanger 11 through a water entrance pipe 61, is heated by the refrigerant, and discharged through a water exit pipe 62. Heating and cooling of the water are performed by changing the flow of the refrigerant by switching of the four-way switching valve 3. When the water is to be cooled, the water heat exchanger 11 acts as a refrigerant evaporator.

(2) Arrangement of Devices in Refrigeration Cycle Apparatus

An arrangement of devices in the refrigeration cycle apparatus will be described by using the front view in FIG. 3 and the top view in FIG. 4. For ease of understanding, detailed description of a refrigerant pipe, a signal line, electric wires, such as an electric power line, and the like is omitted, as appropriate, in FIG. 3 and FIG. 4.

Figure 3:
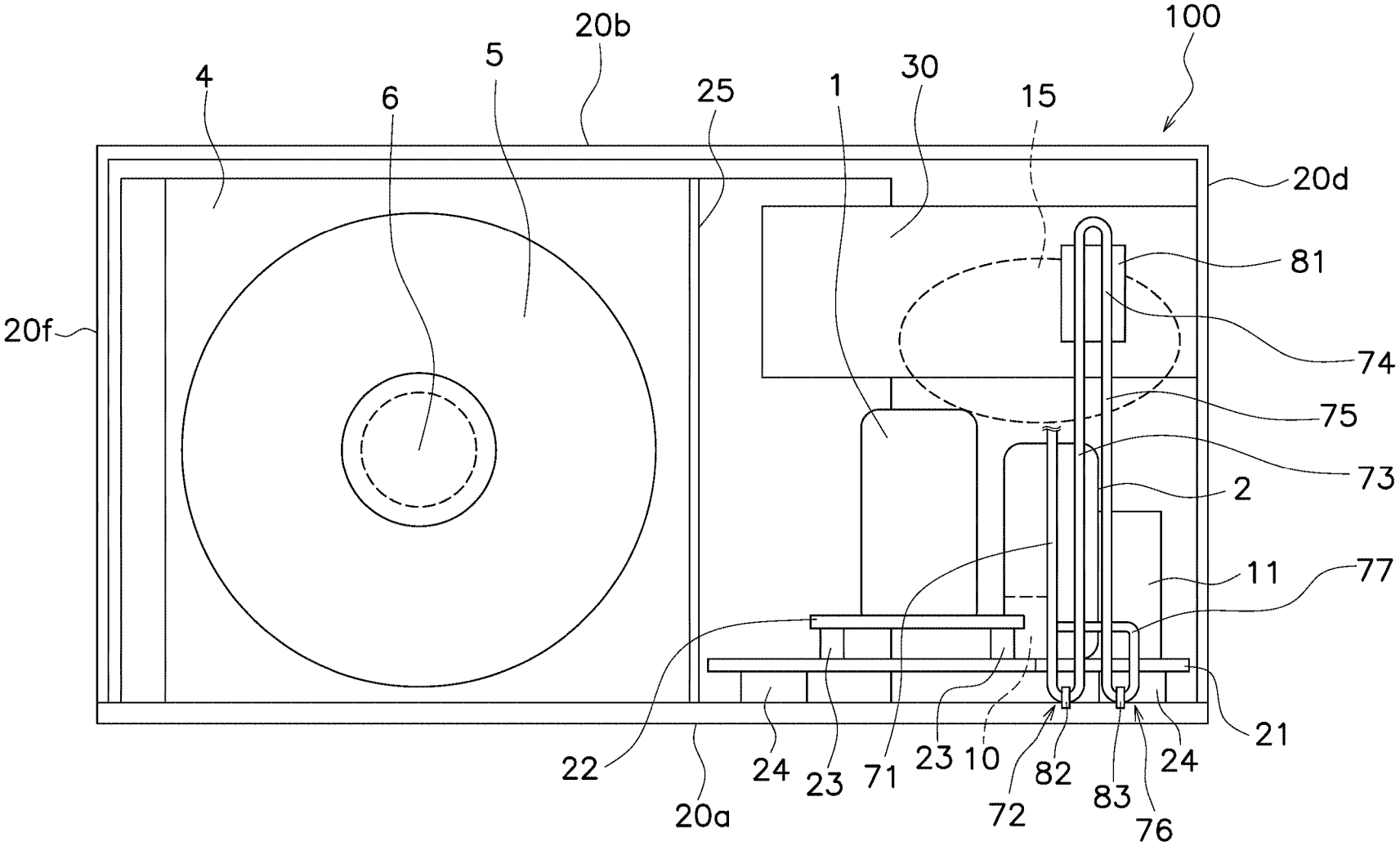
FIG. 3 is a schematic front view of the refrigeration cycle apparatus of the first embodiment.
Figure 4:
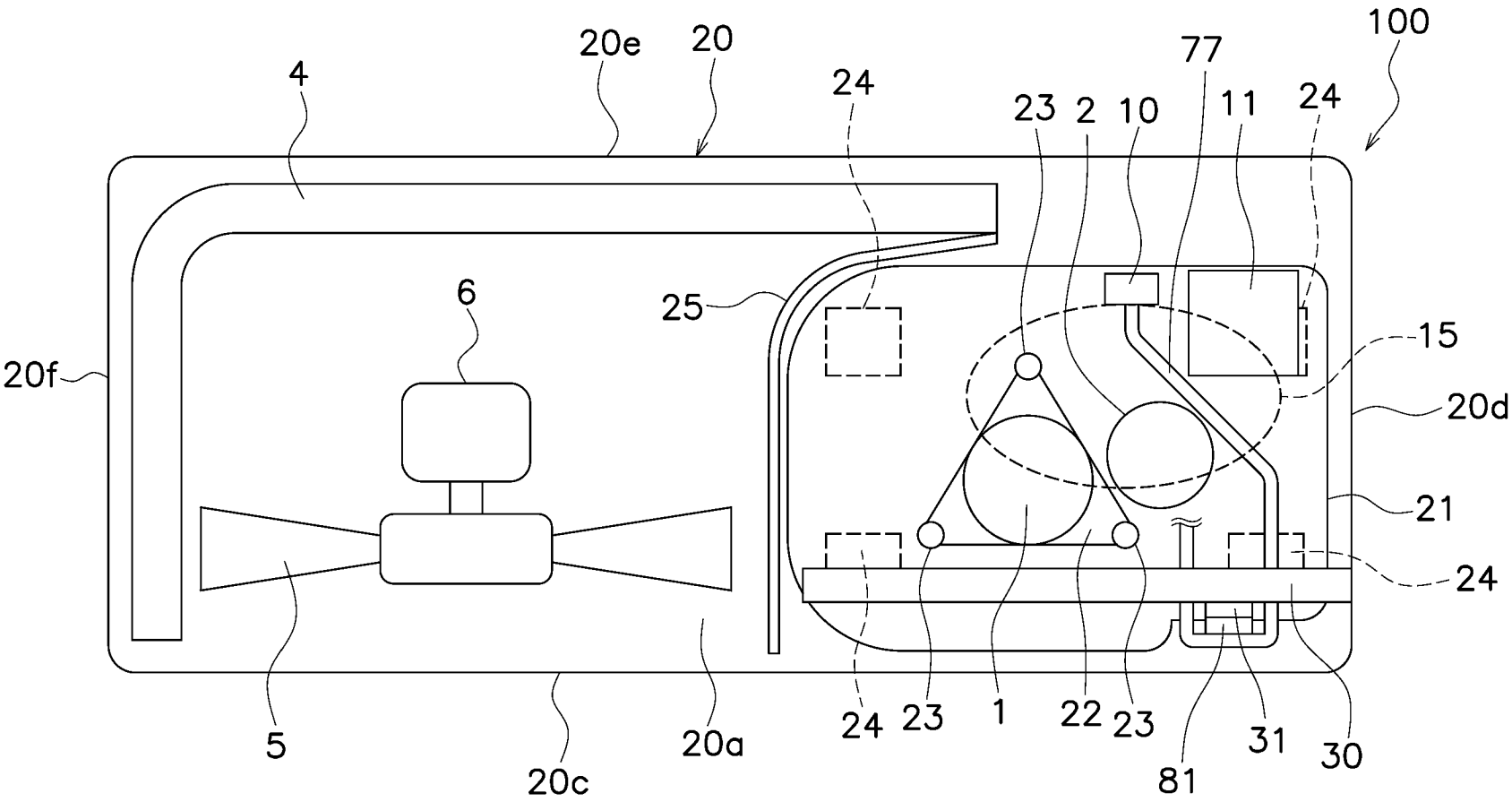
FIG. 4 is a top view of the refrigeration cycle apparatus of the first embodiment.

As illustrated in FIGS. 1, 3, and 4, a housing 20 is constituted by a bottom member 20*a*, a top member 20*b*, a front member 20*c*, a right-side member 20*d*, a rear member 20*e*, and a left-side member 20*f*. The housing 20 covers the outer side of devices constituting the refrigeration cycle.

As illustrated in FIGS. 3 and 4, a space in an inner portion of the housing 20 is divided by a partition plate 25 into, roughly, a heat exchange chamber on the left side in which the air heat exchanger 4 and the fan 5 are disposed and a machine chamber on the right side in which devices, such as the compressor 1 and the like, are disposed.

As illustrated in FIG. 3, in the machine chamber, four second elastic members 24 are disposed on the bottom member 20*a*, and a base 21 is disposed on the second elastic members 24. The second elastic member 24 is disposed at each of the corners of the base 21 in FIG. 4 but may be constituted by one large piece or may be divided into two or more. A material of the second elastic members 24 is rubber or urethane.

The compressor 1 includes an elastic-member mount portion 22. The first elastic members 23 are mounted on the elastic-member mount portion 22. The compressor 1 is supported on the base 21 by three first elastic members 23 and bolts (not illustrated). The first elastic members 23 are anti-vibration rubber.

The compressor 1 may be supported on the base 21 by the first elastic members and bolts or may be supported on the base 21 by only the first elastic members.

If being capable of supporting the compressor 1, the first elastic members 23 may be constituted by one piece or may be constituted by a plurality of first elastic members. A material of the first elastic members 23 may be, other than rubber, urethane. The material and the spring constant may be different or the same between the first elastic members 23 and the second elastic members 24.

In other words, the compressor 1 is disposed on a double anti-vibration structure via the first elastic members 23, the base 21, and the second elastic members 24. Consequently, even when the compressor 1 vibrates due to operation of the refrigeration cycle apparatus 100, transmission of the vibration and generation of noise are suppressed by the double anti-vibration structure.

As illustrated in FIG. 2, FIG. 3, and FIG. 4, in addition to the compressor 1, the economizer heat exchanger 10, the water heat exchanger 11, the accumulator 2, a receiver (not illustrated), and other refrigeration-cycle constituent components 15 are disposed and fixed on the base 21. The other refrigeration-cycle constituent components 15 represent the first expansion valve 7, the second expansion valve 8, the check valve 9, the four-way switching valve 3, and the like. The refrigeration-cycle constituent components 15 are fixed to the base 21 by a pipe and another support member (not illustrated).

An electric component 31 is fixed to an electric-component unit 30. The electric component 31 drives a motor for the compressor. The motor for the compressor is a part of the compressor 1. The electric-component unit also includes an electric component other than the electric component 31.

The electric component 31 is a heat generating component. The electric-component unit 30 is fixed to the housing 20. The electric-component unit 30 is disposed in an upper portion of the machine chamber.

In the first embodiment, devices at a portion other than a portion surrounded by the area of the base 21 of FIG. 2, that is, the air heat exchanger 4, the fan 5, and the fan motor 6 are fixed to the housing 20. The air heat exchanger 4, the fan 5, and the fan motor 6 may be fixed on the base 21. A rectifier member (bell mouth) that rectifies wind generated by the fan may be fixed on the base 21. As a load on the base 21 is increased, the vibration of the base 21 is suppressed more. A drift of wind can be suppressed by placing the fan 5 and the air heat exchanger 4, or/and the fan 5 and the rectifier member on the base 21 at the same time.

(3) Connection Between Refrigerant Cooling Pipe 74 and Refrigerant Pipe

With FIG. 2 to FIG. 4, connection between a refrigerant cooling pipe 74 and a refrigerant pipe will be described.

The refrigerant cooling pipe is disposed at an intermediate portion of either one pipe of the refrigerant pipes 41 to 54 illustrated in the refrigerant circuit diagram of FIG. 2. The portion may be of any of the refrigerant pipes 41 to 54. The portion can be selected from places where the refrigerant has a temperature suitable for cooling and where pipes are easily connected. Considering the temperature of the refrigerant, a suitable place is, for example, the pipe 47, 46, 45, or the like where the temperature is lower than a heat resistant temperature zone of the electric component and higher than a temperature zone in which condensation and the like are generated. Here, a case in which the pipe 47 is selected will be described more specifically.

The refrigerant pipe 47 is a pipe that connects the check valve 9 and the economizer heat exchanger 10 to each other. In FIG. 3 and FIG. 4, the check valve 9 is a part of the refrigeration-cycle constituent components 15 and fixed to the base 21. As illustrated in FIG. 3 and FIG. 4, the economizer heat exchanger 10 is fixed to the base 21. In FIGS. 3 and 4, the refrigerant pipe 47 corresponds to pipes 71 to 77. The pipe 71 is in the air (is not supported by another member), a vibration transmission suppressing portion 72 is fixed to the housing 20 by a fastener 82, and the pipe 73 is in the air. The refrigerant cooling pipe 74 is fixed to a heat transfer plate 81, the pipe 75 is in the air, and a vibration transmission suppressing portion 76 is fixed to the housing 20 by a fastener 83. The pipe 77 is in the air and, as illustrated in FIG. 4, is connected to the economizer heat exchanger 10.

The refrigerant cooling pipe 74 is fixed to the heat transfer plate 81, and the heat transfer plate 81 is bonded to an element of the electric component 31. Therefore, when the electric component generates heat, the electric component can be cooled by the refrigerant. In the present embodiment, the pipes 71 to 77 are constituted by one folded refrigerant pipe. The refrigerant cooling pipe 74 is formed by the pipes 71 to 77 a portion of which is fixed to the heat transfer plate 81 by a method, such as brazing, welding, or the like.

As the refrigerant cooling pipe 74, a refrigerant jacket may be used (refer to, for example, Japanese Unexamined Patent Application Publication No. 2010-145054). The refrigerant jacket is a plate made of metal, such as aluminum or the like, and includes a flow channel for causing the refrigerant to circulate therein. The flow channel and the pipes 73 and 75 may be connected to each other. When the refrigerant jacket is used, the heat transfer plate 81 and the refrigerant cooling pipe 74 may be formed integral with each other.

A portion of the connecting pipe 47 is fixed as the vibration transmission suppressing portions 72 and 76 to the housing 20 with the fasteners 82 and 83. The portion of the connecting pipe 47 is fixed to the bottom member 20*a* of the housing 20. The fasteners 82 and 83 are made of metal, for example, made of iron. Therefore, even when the base 21 vibrates, the vibration is suppressed by the vibration transmission suppressing portions 72 and 76, and the vibration of the refrigerant cooling pipe 74 can be suppressed.

(4) Features 4-1

In the refrigeration cycle apparatus 100 of the present embodiment, the compressor 1 is disposed on the bottom member 20*a* via the first elastic members 23, the base 21, and the second elastic members 24. In other words, the double anti-vibration structure is employed to thereby address suppression of transmission of the vibration of the compressor 1 and calmness. In such a double anti-vibration structure, refrigeration-cycle components, such as the accumulator 2, the water heat exchanger 11, and the like, are fixed on the base 21, and thus, suppression of transmission of vibration and calming action are further reinforced.

In the refrigeration cycle apparatus 100 of the present embodiment, the electric component 31 that includes a heat generating element is cooled by the refrigerant cooling pipe 74, and thus, efficiency of the electric component 31 is improved while malfunction and deterioration of the electric component 31 due to a temperature rise are prevented.

The refrigeration cycle apparatus 100 of the present embodiment further includes, in the apparatus having such a double anti-vibration structure and a refrigerant cooling structure, the vibration transmission suppressing portion 72 at the connecting pipes 71 to 73 connecting the refrigeration-cycle constituent components (for example, the economizer heat exchanger 10) and the refrigerant cooling pipe 74 to each other.

In the refrigeration cycle apparatus 100 of the present embodiment, the refrigerant cooling pipe 74 (electric component 31) is fixed to the housing 20 with the refrigeration-cycle constituent components (for example, the economizer heat exchanger 10) being fixed to the base 21, and thus, due to the vibration of the base 21, displacement is generated between the refrigeration-cycle constituent components and the refrigerant cooling pipe 74. Consequently, there is a likelihood of excessive stress concentration being generated on the refrigerant cooling pipe 74. When a stress is applied to pipes by vibration repeatedly, fatigue fracture occurs, and there is a likelihood of the pipes being broken, resulting in refrigerant leakage and the like. In the refrigeration cycle apparatus of the present embodiment, however, the vibration transmission suppressing portions 72 and 76 are provided, and therefore, the vibration of the base 21 is suppressed before being transmitted to the refrigerant cooling pipe 74. Accordingly, the stress of the refrigerant cooling pipe 74 is reduced, and a risk of causing fatigue fracture is also reduced.

4-2

In the refrigeration cycle apparatus 100 of the present embodiment, the vibration transmission suppressing portions 72 and 76 are fixed to the housing 20, particularly to the bottom member 20*a*.

In contrast, the electric component 31 (refrigerant cooling pipe 74) of the present embodiment is disposed in an upper portion inside the housing 20. Consequently, the connecting pipes 73 and 75 connecting the refrigerant cooling pipe 74 and the vibration transmission suppressing portions 72 and 76 are lengthened, and a vibration reducing effect is easily obtained.

The bottom member 20*a* is the highest among the six members constituting the housing 20 in terms of rigidity. Thus, the vibration suppression effect is high.

In the maintenance of the refrigeration cycle apparatus 100, the top member 20*b*, the front member 20*c*, the right-side member 20*d*, the rear member 20*e*, and the left-side member 20*f* are required to be detached, and, however, the bottom member 20*a* is seldom detached. Thus, when the vibration transmission suppressing portions 72 and 76 are fixed to the bottom member 20*a*, there is no need to detach the vibration transmission suppressing portions 72 and 76 for maintenance, and maintenance properties are improved.

(5) Modification

(5-1) Modification 1A

In the first embodiment, the refrigerant cooling pipe 74 is disposed at the pipe 47 connecting the check valve 9 and the economizer heat exchanger 10. In a modification 1A, the refrigerant cooling pipe 74 is disposed at the pipe 46 in FIG. 2. The pipe 46 is a pipe that connects the economizer heat exchanger 10 and an injection junction 12 to each other. The refrigerant in the pipe 46 has a slightly low temperature, compared with the temperature of the refrigerant in the pipe 47, and thus has a slightly high cooling ability. Selection between them is determined on the basis of cooling ability, and ease of connection depending on the arrangements of the pipes.

The effect of the modification 1A is almost the same as that of the first embodiment.

Not only the pipe 46 and the pipe 47, but also the pipe 41 to pipe 51 in FIG. 2 can be used as connecting pipes at which the refrigerant cooling pipe 74 is disposed. However, vibration is increased because each of the pipes 41, 51, and 54 is connected at one end thereof to the compressor 1. In contrast, in the first embodiment, the air heat exchanger 4 is fixed to the housing 20, and thus, each of the pipes 42 and 43 connected at one end thereof to the air heat exchanger 4 is preferable from the point of view of vibration suppression.

(5-2) Modification 1B

Figure 5:
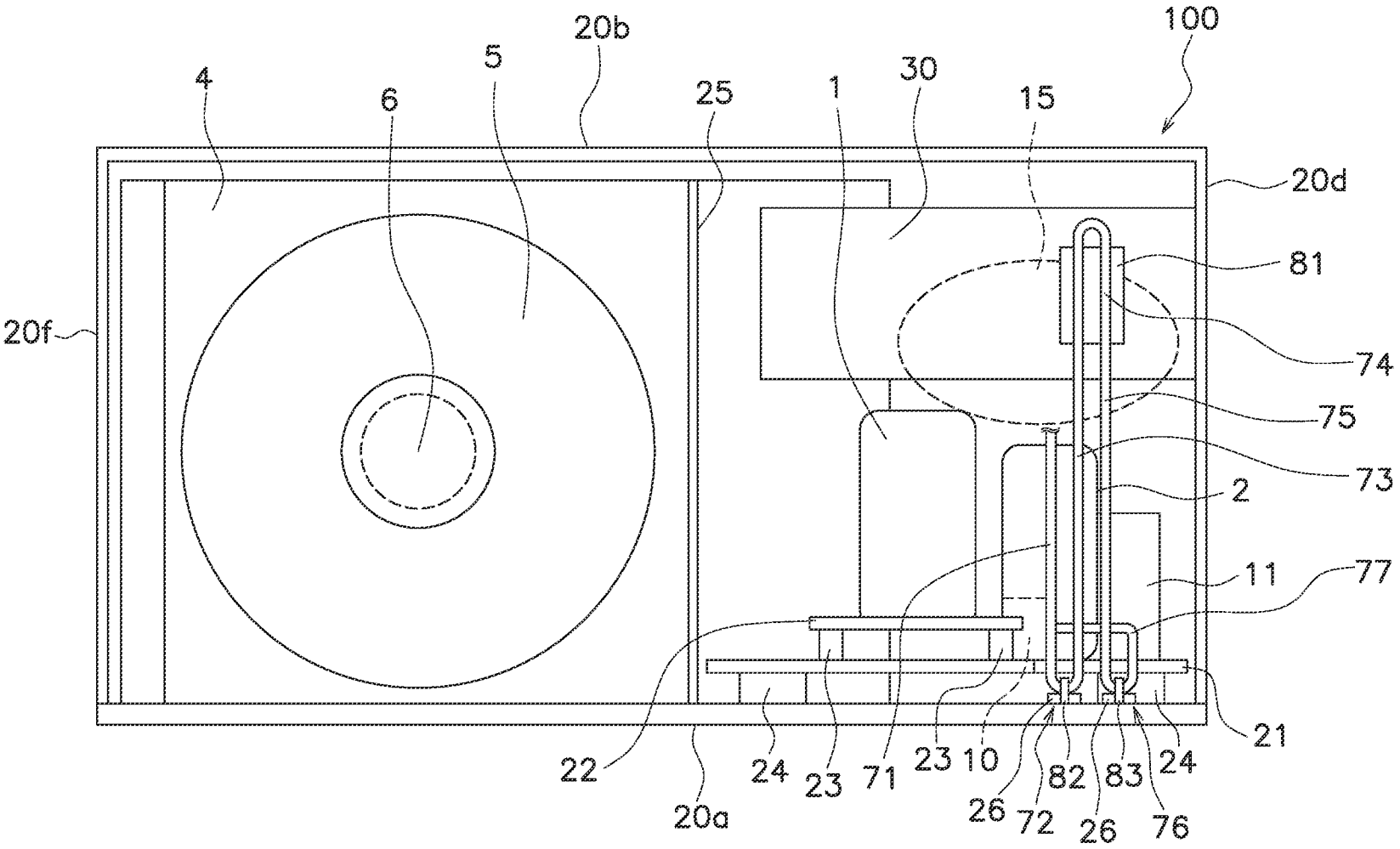
FIG. 5 is a schematic front view of the refrigeration cycle apparatus according to a modification of the first embodiment.

In the first embodiment, a case in which the vibration transmission suppressing portions 72 and 76, which are pipes, are in direct contact with the bottom member 20*a* and fixed thereto has been described. In a modification 1B, as illustrated in FIG. 5, the vibration transmission suppressing portions 72 and 76 are fixed to the bottom member 20*a* with a third elastic member 26 interposed therebetween. The feature of fixing with the fasteners 82 and 83 is the same. The third elastic member 26 may be interposed between the fasteners 82 and 83 and the vibration transmission suppressing portions 72 and 76.

In the refrigeration cycle apparatus of the modification 1B, the third elastic member 26 attenuates vibration, and it is thus possible to reduce vibration energy that is transmitted to the housing.

In the modification 1B, the spring constant of the third elastic member 26 may be more than or equal to the single spring constant of the second elastic member 24. With such a configuration, displacement due to vibration transmitted to the refrigerant cooling pipe 74 can be reliably suppressed, compared with displacement due to the vibration of the base 21, and it becomes possible to attenuate vibration that is transmitted from the vibration transmission suppressing portions 72 and 76 to the housing 20.

(5-3) Modification 1C

In the first embodiment, a case in which the vibration transmission suppressing portions 72 and 76, which are a part of the connecting pipe, are fixed to the housing 20 has been described. In a modification 1C, a part of the connecting pipe is fastened to the housing 20 with flexible metal. The flexible metal is, for example, a wire. Also in such a case, it is possible to suppress the vibration of the base 21 from being transmitted to the refrigerant cooling pipe 74. The effect thereof is, however, limited compared with that in the first embodiment.

(5-4) Modification 1D

In the first embodiment, a case in which the vibration transmission suppressing portions 72 and 76, which are a part of the connecting pipe, are fixed to the housing 20 has been described. In a modification 1D, the vibration transmission suppressing portions 72 and 76 are traps. An example thereof is a pipe that is bent in a U-shape.

The traps absorb displacement resulting from the vibration of the base and can suppress the vibration of the refrigerant cooling pipe. Thus, it is possible to prevent excessive stress concentration from being applied to the refrigerant cooling pipe 74.

(5-5) Modification 1E

In the first embodiment, a case in which the vibration transmission suppressing portions 72 and 76, which are a part of the connecting pipe, are fixed to the housing 20 has been described. In a modification 1E, the vibration transmission suppressing portions 72 and 76 are pipes having flexibility. In other words, the vibration transmission suppressing portions 72 and 76 are flexible pipes. The flexible pipes absorb displacement resulting from the vibration of the base and can suppress the vibration of the refrigerant cooling pipe. Thus, it is possible to prevent excessive stress concentration from being applied to the refrigerant cooling pipe 74.

Although embodiments of the present disclosure have been described above, it should be understood that various changes in forms and details are possible without deviating from the gist and the scope of the present disclosure described in the claims.

REFERENCE SIGNS LIST

1 compressor
2 accumulator
3 four-way switching valve
4 air heat exchanger
5 fan
6 fan motor
7 first expansion valve
8 second expansion valve

9 check valve
10 economizer heat exchanger
11 water heat exchanger
20 housing
20*a* bottom member
21 base
23 first elastic member
24 second elastic member
30 electric-component unit
31 electric component
71 to 77 connecting pipe
72, 76 vibration transmission suppressing portion
81 heat transfer plate
100 refrigeration cycle apparatus

CITATION LIST

Patent Literature

PTL 1: Japanese Unexamined Patent Application Publication No. 2005-241197

The invention claimed is:

1. A refrigeration cycle apparatus comprising:
a housing including a bottom member;
a second elastic member disposed on the bottom member;
a base disposed on the bottom member via the second elastic member;
a first elastic member disposed on the base;
a compressor disposed on the base via the first elastic member and configured to compress a refrigerant;
an electric component fixed to the housing and configured to drive a motor for the compressor;
a heat transfer plate fixed to the electric component;
a refrigerant cooling pipe through which the refrigerant circulate;
a refrigeration-cycle constituent component fixed to the base and disposed in a circulation path of the refrigerant; and
a connecting pipe through which the refrigerant circulates, one end of the connecting pipe being directly connected to the refrigeration-cycle constituent component or the compressor and the other end of the connecting pipe being directly connected to the refrigerant cooling pipe, with the other end of the refrigerant cooling pipe being directly connected to the compressor or another refrigeration-cycle constituent component fixed to the base and disposed in the circulation path of the refrigerant, wherein
the refrigerant cooling pipe is fixed to the heat transfer plate and is configured to cool the electric component via the heat transfer plate,
the connecting pipe includes a vibration transmission suppressing portion that suppresses vibration of the refrigeration-cycle constituent component or the compressor fixed to the base from being transmitted to the refrigerant cooling pipe, and
each refrigeration-cycle constituent component that is directly connected to the connecting pipe is one of an economizer heat exchanger, an expansion valve, a check valve, an air heat exchanger, a water heat exchanger, a four way switching valve, and a receiver, or a combination thereof.

2. The refrigeration cycle apparatus according to claim 1, wherein the refrigeration-cycle constituent component that is directly connected to the connecting pipe is one that is included in a group consisting of an economizer heat exchanger, an expansion valve, and a check valve, and a receiver, or a combination thereof.

3. The refrigeration cycle apparatus according to claim 2, wherein the vibration transmission suppressing portion is fixed to the housing.

4. The refrigeration cycle apparatus according to claim 2, the refrigeration cycle apparatus further comprising:
a third elastic member disposed between the vibration transmission suppressing portion and the housing.

5. The refrigeration cycle apparatus according to claim 2, wherein the vibration transmission suppressing portion is a trap including a bent portion.

6. The refrigeration cycle apparatus according to claim 2, wherein the vibration transmission suppressing portion is a pipe having flexibility.

7. The refrigeration cycle apparatus according to claim 1, wherein the vibration transmission suppressing portion is fixed to the housing.

8. The refrigeration cycle apparatus according to claim 7, the refrigeration cycle apparatus further comprising:
a third elastic member disposed between the vibration transmission suppressing portion and the housing.

9. The refrigeration cycle apparatus according to claim 7, wherein the vibration transmission suppressing portion is fixed to the bottom member.

10. The refrigeration cycle apparatus according to claim 9, the refrigeration cycle apparatus further comprising:
a third elastic member disposed between the vibration transmission suppressing portion and the housing.

11. The refrigeration cycle apparatus according to claim 1, the refrigeration cycle apparatus further comprising:
a third elastic member disposed between the vibration transmission suppressing portion and the housing.

12. The refrigeration cycle apparatus according to claim 11,
wherein a spring constant of the third elastic member is more than or equal to a spring constant of the second elastic member.

13. The refrigeration cycle apparatus according to claim 1,
wherein the vibration transmission suppressing portion is a trap including a bent portion.

14. The refrigeration cycle apparatus according to claim 1,
wherein the vibration transmission suppressing portion is a pipe having flexibility.

* * * * *